US007821418B2

(12) United States Patent
Parker et al.

(10) Patent No.: US 7,821,418 B2
(45) Date of Patent: Oct. 26, 2010

(54) SAFETY SYSTEM

(75) Inventors: Ian Parker, Guiseley (GB); Ken Naylor, Huddersfield (GB); Fred Keery, Bradford (GB); Christopher M Butler, Leeds (GB)

(73) Assignee: Cronapress Limited, Guiseley, West Yorkshire (GB)

( * ) Notice: Subject to any disclaimer, the term of this patent is extended or adjusted under 35 U.S.C. 154(b) by 307 days.

(21) Appl. No.: 11/739,362

(22) Filed: Apr. 24, 2007

(65) Prior Publication Data

US 2008/0266082 A1 Oct. 30, 2008

(51) Int. Cl.
*G08B 23/00* (2006.01)

(52) U.S. Cl. ..... 340/693.5; 248/542; 318/54; 49/26

(58) Field of Classification Search ..... 340/693.5, 340/500; 248/542; 318/54, 55, 56; 49/26, 49/27, 28

See application file for complete search history.

(56) References Cited

U.S. PATENT DOCUMENTS

| | | | | |
|---|---|---|---|---|
| 3,753,221 | A | 8/1973 | Stevens | |
| 3,805,732 | A * | 4/1974 | Reed | 116/94 |
| 3,936,606 | A * | 2/1976 | Wanke | 381/71.5 |
| 4,960,079 | A * | 10/1990 | Marziale et al. | 122/504.2 |
| 5,027,552 | A * | 7/1991 | Miller et al. | 49/27 |
| 5,548,275 | A | 8/1996 | Shambayati et al. | |
| 5,921,026 | A | 7/1999 | Miller | |
| 6,040,536 | A | 3/2000 | Miller et al. | |
| 6,278,884 | B1 | 8/2001 | Kim | |
| 2006/0028157 | A1 * | 2/2006 | Ying | 318/56 |

FOREIGN PATENT DOCUMENTS

| | | | |
|---|---|---|---|
| DE | 36 36 596 | | 5/1988 |
| DK | 3 636596 | * | 5/1988 |
| DK | 3636596 | * | 5/1988 |
| GB | 2063536 | | 6/1981 |
| GB | 2091874 | | 1/1982 |
| GB | 2128649 | | 5/1984 |
| GB | 2186683 | | 8/1987 |
| GB | 2288014 | | 4/1995 |
| GB | 2409085 | | 6/2005 |
| KR | 20090034058 | | 10/2007 |
| NZ | 563514 | | 11/2007 |

(Continued)

OTHER PUBLICATIONS

European Search Report dated Sep. 20, 2007.

(Continued)

*Primary Examiner*—Davetta W Goins
*Assistant Examiner*—Edny Labbees
(74) *Attorney, Agent, or Firm*—Harness, Dickey & Pierce, P.L.C.

(57) ABSTRACT

This invention relates to a safety system comprising an elongate signal carrying device having a first end and a second end. At least a part of the elongate signal carrying device is selectively manipulable at a manipulation point to generate a measurable non-electric signal that can be carried by the signal carrying device. The safety system further comprises an output device for causing an audible or visible alarm signal or an electric signal to be outputted in response to the non-electric signal.

32 Claims, 9 Drawing Sheets

FOREIGN PATENT DOCUMENTS

| | | | |
|---|---|---|---|
| WO | WO 02/071356 | | 9/2002 |
| WO | WO 02071356 | * | 9/2002 |
| WO | WO 02071356 A1 | * | 9/2002 |
| WO | WO 2006/083551 | | 8/2006 |
| WO | WO 2006083551 A2 | * | 8/2006 |
| WO | WO 2006083551 A2 | * | 8/2006 |

OTHER PUBLICATIONS

Examination Report for GB 0517456.0 dated Mar. 8, 2010.

* cited by examiner

FIG. 9
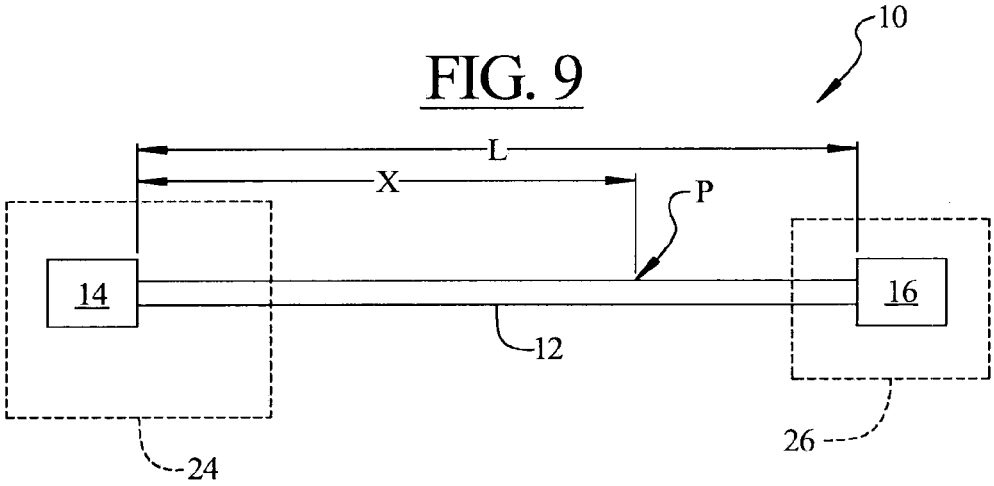
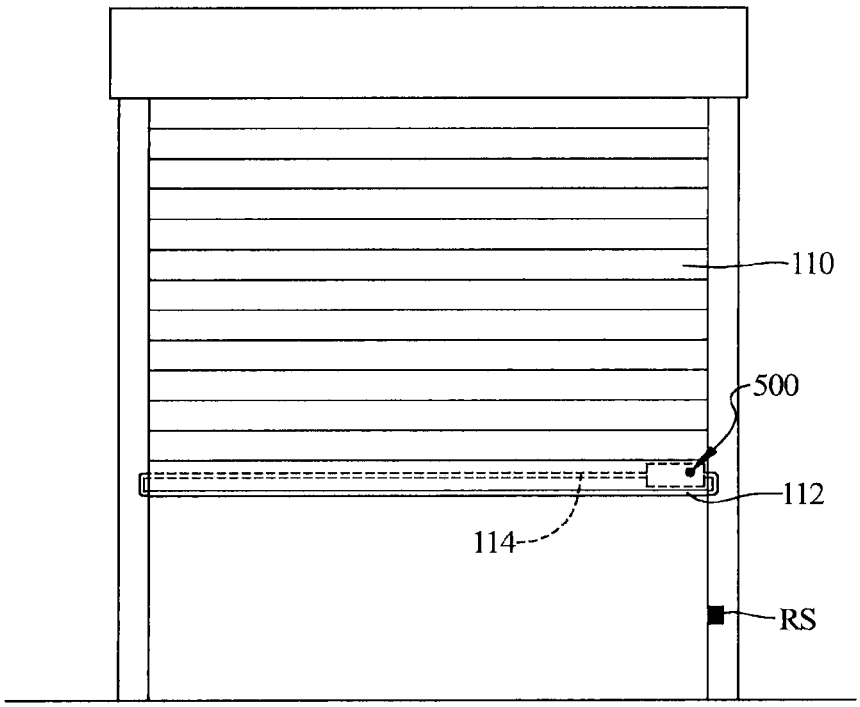
FIG. 10

500
POWER-ON RESENT INITIALIZE THE SYSTEM
120
GO TO SLEEP
122
WAKE UP FROM SLEEP
124
GROUND SENSOR OFF ?
126
NO
128
DELAY
GO TO SLEEP
130
YES
TURN MSMT SYSTEM ON AND ALLOW SETTLING TIME
132
BATTERY VOLTAGE OK ?
134
NO
SIGNAL LOW VOLTAGE
135
YES
138
READ SENSOR 1 AND CALCULATE SIGNAL LIMITS
GROUND SENSOR OFF ?
140
NO
A
YES
SIGNAL INSIDE LIMITS ?
142
NO
RAISE DOOR
144
GO TO SLEEP
146
YES
TIMED OUT ?
148
YES
NO
150
GO TO SLEEP

FIG. 12A
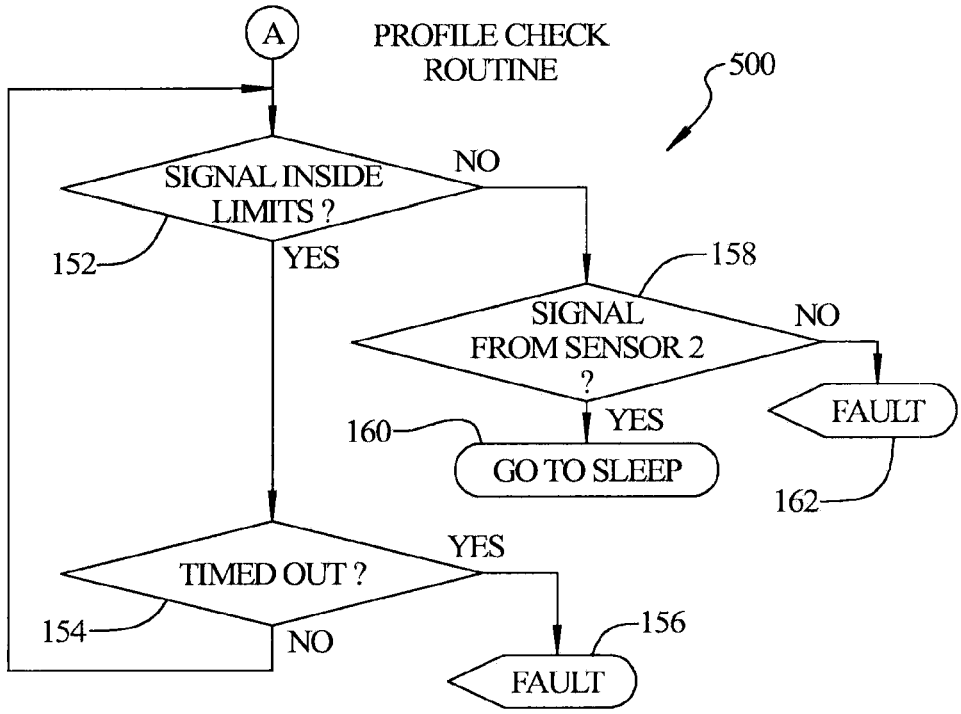
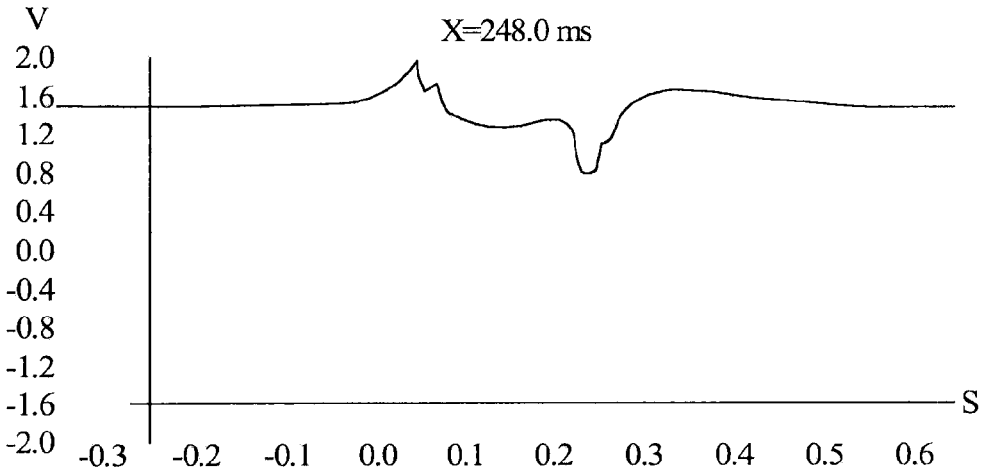
FIG. 13

SAFETY SYSTEM

FIELD OF THE INVENTION

The present disclosure relates to safety system (e.g. an alarm safety system or a garage door edge safety system).

BACKGROUND

The statements in this section merely provide background information related to the present disclosure and may not constitute prior art. Current alarm safety systems (such as multi-point fire safety systems) allow users to activate an alarm signal by operating any one of a plurality of switches at different locations in a room, building, vehicle, etc. Upon operating an "activation point", for example by pressing a switch, an electrical signal is sent via a cable to a central processing unit. Upon receipt of the electrical signal, the central processing unit emits an alarm signal, such as an audible or visible alarm signal.

There are a number of disadvantages associated with such multi-point electric safety systems. Firstly, they can be expensive and difficult to install. Also, such safety systems are not suited to certain environments. For example, there can be disadvantages when using such safety systems in dirty, for example wet, environments. Further, due to the expense of and difficulty in installing such systems, they are not suited for temporary applications.

Alarm safety systems which rely on electromagnetic signals are disclosed for example in GB-A-2128649, GB-A-2409085, GB-A-2288014, U.S. Pat. No. 5,548,275, GB-A-2186683, GB-A-2091874, GB-A-2063536, WO-A-99/38182 and U.S. Pat. No. 3,753,221.

Current safety edge systems for garage door applications use continuous contact strip metal contacts or pneumatic tubes to allow activation of the edge at all points. For copper contacts, the system detects a closed circuit and outputs accordingly. For pneumatic edges, a particular volume of air must be displaced in a sealed chamber to allow a diaphragm to close two electrical contacts.

There are a number of disadvantages to these systems which can result in poor performance. For example, an electrical safety edge that utilizes two contacts where either have ferrous content are prone to rust when seals are broken and can short out. The pneumatic edge requires an airtight seal throughout the system as the loss of pressurization when pressed will not activate the pressure diaphragm.

SUMMARY

The present invention seeks to provide an improved safety system which is cheap and easy to install and can operate in a wide variety of environments including dirty environments.

According to a first aspect there is provided a safety system comprising: an elongate signal carrying device having a first end and a second end, at least a part of which is manipulable at a manipulation point to generate a measurable non-electric signal that can be carried by the signal carrying device; and an output device for causing an audible alarm signal, a visible alarm signal or an electric signal to be outputted in response to the non-electric signal.

By using a non-electric signal carrying device it is not necessary to include electrical components in the part of the safety system that is manipulated. This is a significant advantage as this enables the safety system to be employed in environments which are undesirable or unsuitable for electrical components. For example, the safety system of the present invention can safely be used in wet environments without risk of electrocuting a user when they manipulate the signal carrying device to raise an alarm, and also without risk of the safety system becoming damaged due to moisture or water interfering with the electric components. Further, the safety system can be used in environments which might induce or interfere with electric currents in electrical components which might cause them to malfunction.

Furthermore the signal carrying device carries the non-electric signal from the manipulation point to the output device so that it is not necessary to include electrical components in the signal carrying device. For example, it is not necessary to include electrical components at the manipulation point, or to include an electrical cable through the signal carrying device to carry an electrical signal. Also, it is not necessary to include electrical components at the output device. Therefore, the present invention is cheaper than current electric safety systems as it is not reliant on expensive electrical components.

It is also an advantage of the present invention that the safety system can be more reliable and more robust than current electric safety systems. This is because it is not necessary to include delicate electrical components in the signal carrying device. Reliability is extremely important in safety systems, as the consequences can be fatal if the safety system does not work when an alarm needs to be raised. Further, due to increased reliability, a safety system according to the present invention can be cheaper to maintain than an electric safety system.

The advantages of the safety system mean that it can be exploited in numerous environments including petrochemical antistatic environments, wet applications, and hostile panic environments. The safety system may be used in garage door edge safety systems.

The signal carrying device may be static or dynamic. Where the signal carrying device is static, it may be manipulated by a moving object. Where the signal carrying device is dynamic, it may be manipulated by a static object.

The signal carrying device may have any cross-sectional shape. For example, the cross-sectional shape may be square, hexagonal or circular. The signal carrying device may have a planar surface for wall or edge mounting.

Preferably the cross-sectional size of the signal carrying device is constant along a substantial portion of its length. Preferably the cross-sectional size of the signal carrying device is constant along its entire length.

The length of the signal carrying device may be between 0.5 meters and 1000 meters long. Preferably the signal carrying device is at least 5 meters long, more preferably at least 20 meters long, especially preferably at least 50 meters long. For example, the length of the signal carrying device can be 100 meters or more.

Preferably the non-electric signal carrying device is flexible. This advantageously allows the path of the non-electric signal carrying device to be diverted around corners and located in environments in which it is not appropriate or desirable for the signal carrying device to be mounted on a planar surface or in a straight line.

The signal carrying device may be capable of carrying a non-electric signal and an electric current. Preferably the signal carrying device is incapable of carrying an electric current. This is advantageous in terms of the safety of the safety system as the signal carrying device acts an insulator to help prevent electrocution in the event of a system malfunction.

In a preferred embodiment, the non-electric signal is generated by a user selectively manipulating the manipulation point of the signal carrying device. For example, the signal could be generated by the user twisting the signal carrying device. Alternatively, the signal could be generated by the user touching the signal carrying device. Further alternatively, the signal could be generated by the user moving the signal carrying device, laterally or longitudinally.

Preferably at least a part of the signal carrying device is compressible to generate the measurable non-electric signal. More preferably at least a part of the signal carrying device is radially compressible to generate the measurable non-electric signal.

Preferably at least 50% of the signal carrying device is manipulable to generate a measurable non-electric signal. More preferably at least 75% of the signal carrying device is manipulable to generate a measurable non-electric signal. Especially preferably at least 95% of the signal carrying device is manipulable to generate a measurable non-electric signal. Most preferably 100% of the signal carrying device is selectively manipulable to generate a measurable non-electric signal. The greater the proportion of the signal carrying device that is manipulable, the greater the number of manipulation points at which an alarm can be raised along the length of the signal carrying device. This is advantageous as it can reduce the distance a user has to travel from their standpoint to a point at which they can raise an alarm.

In a first preferred embodiment, the signal carrying device is wall-mountable. This embodiment may be useful in an alarm safety system (e.g. an intruder system).

In a second preferred embodiment, the signal carrying device is edge-mountable on a movable garage door. This embodiment exploits the sensitivity of the system without the complexity of metal contacts or the required integrity of a sealed pneumatic system. The signal carrying device is typically mountable on the leading edge of the movable garage door.

The output device may cause an audible alarm signal, a visible alarm signal or an electric signal to be outputted in response to a quantitative or qualitative characteristic of the non-electric signal. The characteristic may be one or more of a shape, size or time of signal deviation from a quiescent signal value.

The output device may cause an electric signal to be outputted in a plurality of different ways. For instance, the output device may output an electric signal to cause a motor to reverse or stop (e.g. "dead man" mode) or cause low voltage notification.

The output device may cause a visible alarm signal or audible alarm signal to be outputted in a plurality of different ways. For instance, the output device may output an audible alarm signal or visible alarm signal directly. For example, the output device may include an audio device for creating a sound in response to the non-electric signal. For example, the audio device may be a bell device. The output device may include a visual device that visibly changes in response to the non-electric signal. For example, the visual device may be a light device that turns on or off in response to the non-electric signal. In particular, the light device may be a Light Emitting Diode (LED). The output device may include a combination of one or more audio and/or visual devices.

The output device may cause a visible or audible alarm signal to be outputted by sending an interim signal to an alarm output device external to the output device which outputs the visible or audible alarm signal in response to the interim signal.

For example, the alarm output device may be an audio device which creates a sound in response to the interim signal. For instance, the audio device could be a siren device or a bell device.

The alarm output device may be a visual device that changes visibly in response to the signal output by the output device. For example, the visual device could be a light device that turns on or off. The visual device may be a LCD screen or a CRT monitor.

The alarm output device may be a combination of one or more audio and/or visual devices.

Furthermore, the alarm output device may be a computing device. For instance the alarm output device could be a computer. In this case, the alarm signal outputted by the computer could be an e-mail message which can be displayed on the screen of the computer. The alarm output device could be a mobile phone. In this case, the alarm signal outputted by the mobile phone could be a SMS text message which can be displayed on the screen on the mobile phone.

The non-electric signal can be any type of signal that indicates a deviation from the normal condition of the signal carrying device. Preferably the signal carrying device is a wave carrying device, wherein the non-electric signal is either a measurable wave generated in the wave carrying device or a measurable disturbance in a wave carried by the wave carrying device in the normal condition. Preferably the wave is non-electromagnetic, particularly preferably a pressure wave (for example an acoustic wave).

The signal carrying device may be a solid or hollow elongate tube. The signal carrying device may be an enclosure. Preferably the signal carrying device is a hollow tube containing a fluid and the non-electric signal is a measurable pressure wave. Particularly preferably the signal carrying device defines an acoustic chamber. Such a signal carrying device can be cheap to manufacture.

When the signal carrying device is a hollow tube containing a fluid, preferably the tube is made from a flexible material. Preferably the material is impervious to air and liquids. Preferably the tube is made from a resiliently flexible material that returns back to its original shape after removal of a shape deforming force. For example, the hollow tube may be made of a rubber material. The hollow tube may be made of a plastic material.

Preferably the fluid is a gas. More preferably the fluid is air. The use of a gas, for instance air, instead of a liquid can increase the ease of manufacture and maintenance of the safety system. Also the density of a gas is less than that of a liquid and therefore a signal carrying device containing gas is easier to manipulate and install than one containing liquid.

Preferably when the gas is air, the air is at atmospheric pressure within the tube. This can be advantageous as it can avoid the need to have to evacuate or pressurize the air within the tube.

When the signal carrying device is a wave carrying device which is selectively manipulable to cause a measurable disturbance in a wave carried through the wave carrying device, preferably the safety system comprises a transmitting device for transmitting a wave through the wave carrying device.

Preferably the safety system further comprises a detector for detecting the non-electric signal wherein the output device is operatively connected to the detector. A detector may be any type of mechanical or electrical detector for detecting the non-electric signal. For example, when the non-electric signal is a pressure wave, the detector is a pressure detector capable of detecting a pressure wave. The pressure detector may comprise a pressure transducer. For example, the pressure detector may comprise a microphone. Preferably the microphone is an electric microphone.

The detector may output a detector output signal that is representative of the non-electric signal. The safety system may further comprise a detector processing device for processing the detector output signal. For example, the detector processing device may comprise a filter device for filtering the parts of the detector output signal that are representative of background non-electric signals. This can be advantageous as the processing device can help to distinguish between non-electric signals generated by the manipulation of the signal carrying device and non-electric signals caused by background noise. For example, when the non-electric signal is a pressure wave, then the detector processing device may be a low-pass filter that is used to attenuate detector output signals that are representative of high-frequency acoustic signals. For example, the acoustic signals might be acoustic noise.

The detector processing device may comprise a comparator having the detector output signal as a first input. The detector processing device may further comprise an amplifier for amplifying the detector output signal. The amplified signal may be passed to the comparator. A second input of the comparator may be an attenuated low pass filtered version of the detector output signal. This is advantageous over providing a fixed reference voltage as it creates a reference voltage that is a fraction of the steady (DC) level of the non-electric signal. Therefore, as conditions change, the reference voltage at the comparator is always related to the average non-electric signal level.

The detector processing device may include two comparators operating at a different voltage levels. This has been found to compensate for differences in amplitude of the non-electric signal which can give rise to errors in the measuring of a non-electric signal generated by a manipulation of the signal carrying device.

Alternatively, the detector processing device may include a digital sampler for digitizing the detector output signal. Again, this has been found to avoid disadvantages associated with the differences in amplitude of the non-electric signal.

The detector can be located at any point along the signal carrying device. Preferably the detector is located at or near to the first end of the signal carrying device. Preferably the detector is located no more than 25% along the length of the signal carrying device from the first end, more preferably no more than 10%, especially preferably no more than 5%. Most preferably, the detector is located at the first end of the signal carrying device. In some circumstances, the presence of the detector can interfere with the structure, integrity and/or signal carrying properties of a signal carrying device. Therefore, it can be advantageous to locate the detecting device at the first end to ensure that any reduction in structural integrity or signal carrying properties of the signal carrying device is minimized.

Preferably the safety system further comprises a positioning system for determining the position of the manipulation point. This can provide a significant number of advantages. In many circumstances, it will be desirable to determine where the signal carrying device was manipulated, so that it can quickly be determined where an alarm was raised and therefore where aid or assistance is required.

Preferably the positioning system comprises a first detector for detecting the non-electric signal proximal the first end of the signal carrying device and a second detector for detecting the non-electric signal distal to the first end of the signal carrying device. It has been found that the provision of two detecting devices at or near to respective ends of the signal carrying device can provide an accurate calculation of the origin of the non-electric signal. This is particularly true when the signal carrying device is a wave carrying device. This is because the speed at which the measurable wave or measurable disturbance propagates through the wave carrying device is known, and also the distance between the two detectors is known. Therefore the manipulation point can be determined by the positioning system by measuring the difference in the time at which the wave was detected by each detector.

Preferably the first detector is located at the first end of the signal carrying device and the second detector is located at the second end of the signal carrying device. In the embodiment of the garage door edge safety system, this can be exploited to confirm the integrity of the safety edge.

The positioning system could output an exact position of the manipulation point. The exact position could be relative to the safety system, relative to a point on the signal carrying device itself or relative to a point external to the safety system. The exact position could be a distance. Alternatively, the length of the signal carrying device could be conceptually divided into a plurality of sections and the positioning system could output in which section the manipulation point is. The sections could be equal or different in length.

Preferably the safety system comprises a testing system capable of testing the safety system. The provision of a testing system enables the safety system to be tested regularly. This is particularly advantageous when the safety system is located in environments in which the safety system (and in particular the signal carrying device) is subject to damage.

Preferably the testing system comprises a test signal generating device capable of generating a measurable non-electric test signal that can be carried by the signal carrying device. The use of a test signal generating device capable of generating a measurable non-electric test signal for testing purposes can be advantageous as it can eliminate the need for a human to physically manipulate the signal carrying device in order to test the safety system.

The test signal generating device may include a manipulating device for mechanically manipulating the signal carrying device. The manipulating device could be arranged to mechanically compress the signal carrying device. Preferably the manipulating device is arranged to mechanically radially compress the signal carrying device. For example, the manipulation device could include a compressing device which can be operated to radially compress the signal carrying device between itself and the surface of another body. Alternatively, the manipulation device could include a contracting device that extends around at least a part of the outer surface of the signal carrying device and which can be operated to contract so as to compress the signal carrying device. For instance, the testing system could include a solenoid whose armature is arranged to compress the tube against a fixed support, thereby radially compressing a part of the signal carrying device.

The test signal generating device may comprise an inducing device for inducing a non-electric test signal in the signal carrying device. For example, when the test signal is an acoustic signal or a pressure wave, the inducing device is capable of inducing a pressure wave in the signal carrying device. In particular, when the signal carrying device is a hollow tube containing a fluid and the non-electric signal is a pressure wave, the test signal generating device could comprise a device for inducing a pressure wave in the hollow tube. For example, the inducing device could be a speaker.

It can be preferable in some circumstances to use an inducing device instead of a manipulating device for mechanically manipulating the signal carrying device as less energy can be required to drive an impulsing device than a compressing device. Also, faster impulses can be generated using an impulsing device than a compressing device. However, in some circumstances it can be preferable to use a compressing device because this does not need direct fluid access to the signal carrying device like an impulsing device, in order to create a pressure wave. For example it might be preferable to use a compressing device rather than an impulsing device when the safety system is to be used in a dirty environment.

Preferably the test signal generating device is controllable to generate a measurable non-electric test signal at intervals preset by a user, or at regular intervals. Preferably the testing system is adapted to cause an audible or visible test alarm signal to be outputted if the testing system does not respond to the detection of the non-electric signal generated by the testing system. More preferably the testing system is operatively connected to a test detector for detecting the non-electric test signal generated by the test signal generating device. Preferably the testing system is adapted to cause an audible or visible alarm signal to be outputted if the detector does not detect the non-electric signal generated by the test signal generating device.

In a preferred embodiment in which the signal carrying device is mounted on a garage door edge, the test signal is generated at closure of the garage door.

Preferably the safety system further comprises a visual monitoring system operatively connected to the output device, wherein the visual monitoring system comprises: at least one camera device capable of generating an image of at least a part of the signal carrying device; and a visual display unit on which the image from the or each camera device can be displayed in response to the non-electric signal. It is an advantage to provide such a visual monitoring system in order for a system operator to be able to view the signal carrying device once an alarm has been raised. This allows the operator to assess whether assistance is required or whether the alarm was a false alarm. Preferably the camera device is a video camera device.

Preferably the visual monitoring system comprises: at least two camera devices, each camera device capable of generating an image of a different part of the signal carrying device wherein the image of at least one part of the signal carrying device is an image of the manipulation point. When the length of the signal carrying device is such that it is not possible to cover the entire length of the signal carrying device with one camera device, then it can be desirable to have different camera devices covering different parts of the signal carrying device. This allows the entire length of the signal carrying device to be covered by the visual monitoring system.

Particularly preferably the visual monitoring system is adapted to display the image of the camera device that generates the image of the part of the signal carrying device which has been manipulated, in response to the non-electric signal. When more than one camera device is used, it is preferable to display on the visual display unit the image from the camera device which covers the part of the signal carrying device which has been manipulated so that the system operator can view the part of the signal carrying device on which the alarm was raised to assess the situation without having to manually choose the relevant camera device.

Preferably the safety system further comprises a spraying device for spraying a substance in response to the non-electric signal. Preferably the substance is a dye. Preferably the safety system further comprises a motion detector for detecting the locality of a moving body and causes the spraying device to spray the substance in the locality.

The manipulation point can be a second manipulation point, and the measurable non-electric signal can be a second measurable non-electric signal, and the output device may be adapted to cause a primer signal to be output in response to a first measurable non-electric signal generated by the manipulation of the signal carrying device at a first manipulation point. Preferably the second measurable non-electric signal is generated within a preselected time after the first measurable non-electric signal, wherein the alarm signal is different from the primer signal.

Preferably the safety system further comprises: a first end system located at a first end of the signal carrying device, wherein the first end system comprises the output device. Preferably the first end system further comprises a testing system. Preferably the first end system further comprises a first detector of a positioning system. Preferably the first end system further comprises a control unit for controlling the output device, testing system and/or positioning system present therein. Preferably the first end system comprises a power supply for powering the first end system.

Preferably when the safety system comprises a first end system comprising a first detector of a positioning system, the safety system further comprises a second end system located at a second end of the signal carrying device, wherein the second end system comprises a second detector of a positioning system and wherein the second end system is operatively connected to the first end system. Preferably the power supply of the first end system also powers the second end system.

According to a second aspect of the present invention, there is provided a method for operating a safety system comprising: manipulating an elongate non-electric signal carrying device at a manipulation point to generate a measurable non-electric signal thereby causing an output device to cause an audible alarm signal, a visible alarm signal or an electric signal to be outputted in response to the non-electric signal.

Preferably the step of manipulating the signal carrying device comprises: compressing the signal carrying device.

Preferably the step of compressing the signal carrying device comprises: radially compressing the signal carrying device.

Preferably the method of operating the safety system further comprises: generating a non-electric test signal to test the safety system.

The manipulation point can be a second manipulation point, and the measurable non-electric signal can be a second measurable non-electric signal. Accordingly, the method can further comprise manipulating the elongate non-electric signal carrying device at a first manipulation point to generate a first measurable non-electric signal to thereby cause the output device to output a primer signal in response to the first non-electric signal.

According to a yet further aspect the present invention provides a movable garage door (e.g. a roller door) having a leading edge which in a closed position contacts the ground, wherein a signal carrying device as defined hereinbefore is mounted on the leading edge.

According to a still yet further aspect the present invention provides a movable garage door edge safety assembly comprising:

a movable garage door having a leading edge which in a closed position contacts the ground, wherein a signal carrying device as defined hereinbefore is mounted on the leading edge; and an output device as defined hereinbefore for causing an audible alarm signal or a visible alarm signal to be output in response to the non-electric signal.

According to an even still yet further aspect the present invention provides an alarm system comprising:

a wall-mounted signal carrying device as defined in any preceding claim; and an output device as defined hereinbefore for causing an electric signal to be output in response to the non-electric signal.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Embodiments of the present invention will now be described by way of example only with reference to the accompanying drawings in which.

Figure 1:
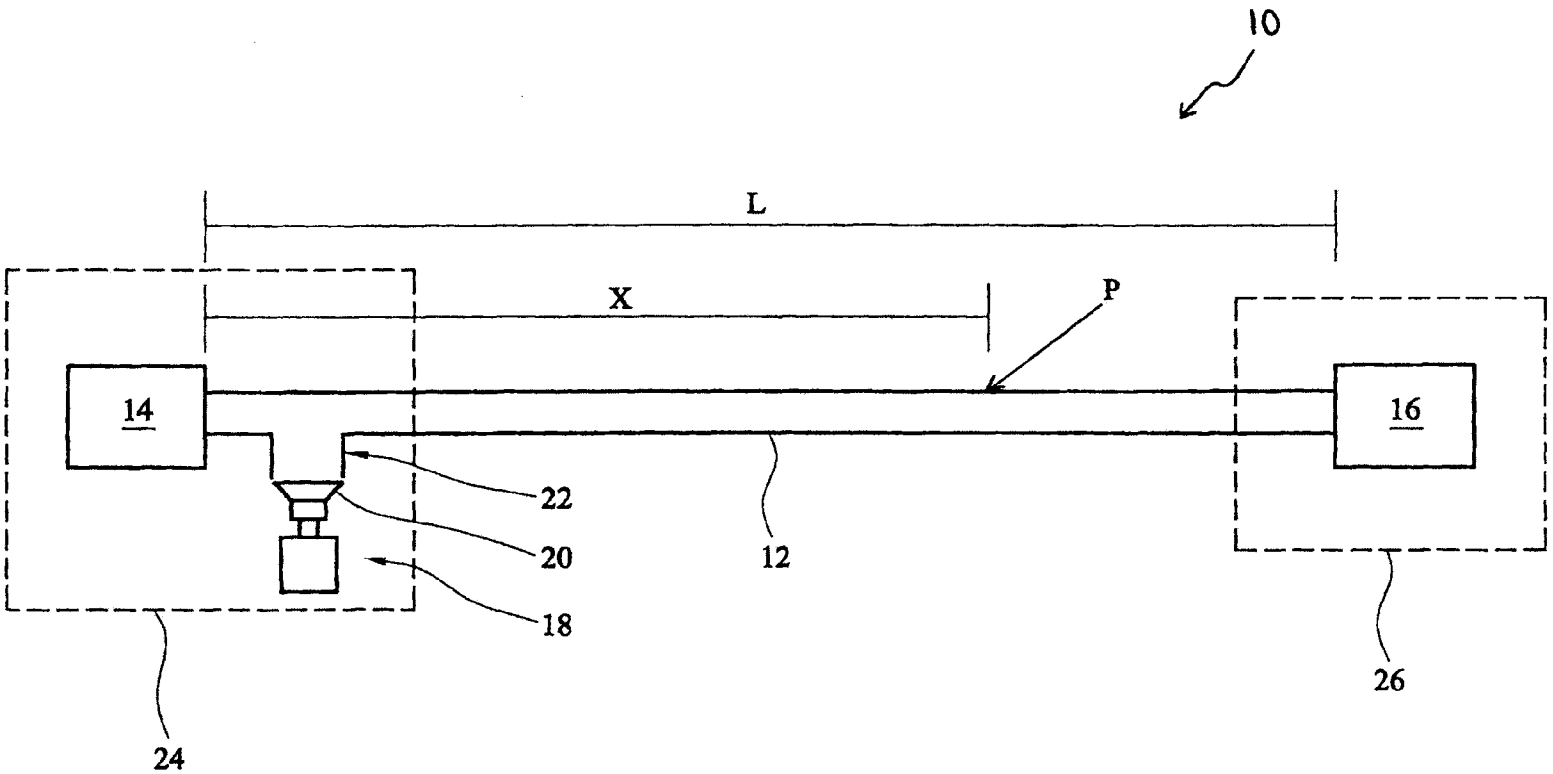
FIG. 1 shows a schematic diagram of an alarm safety system in accordance with the present invention.
Figure 7A:
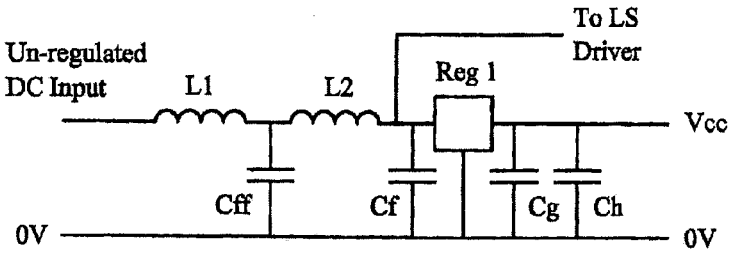
Figure 7B:
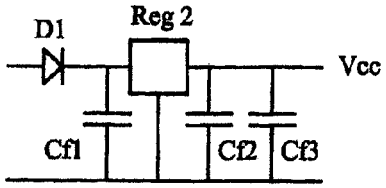
Figure 8:
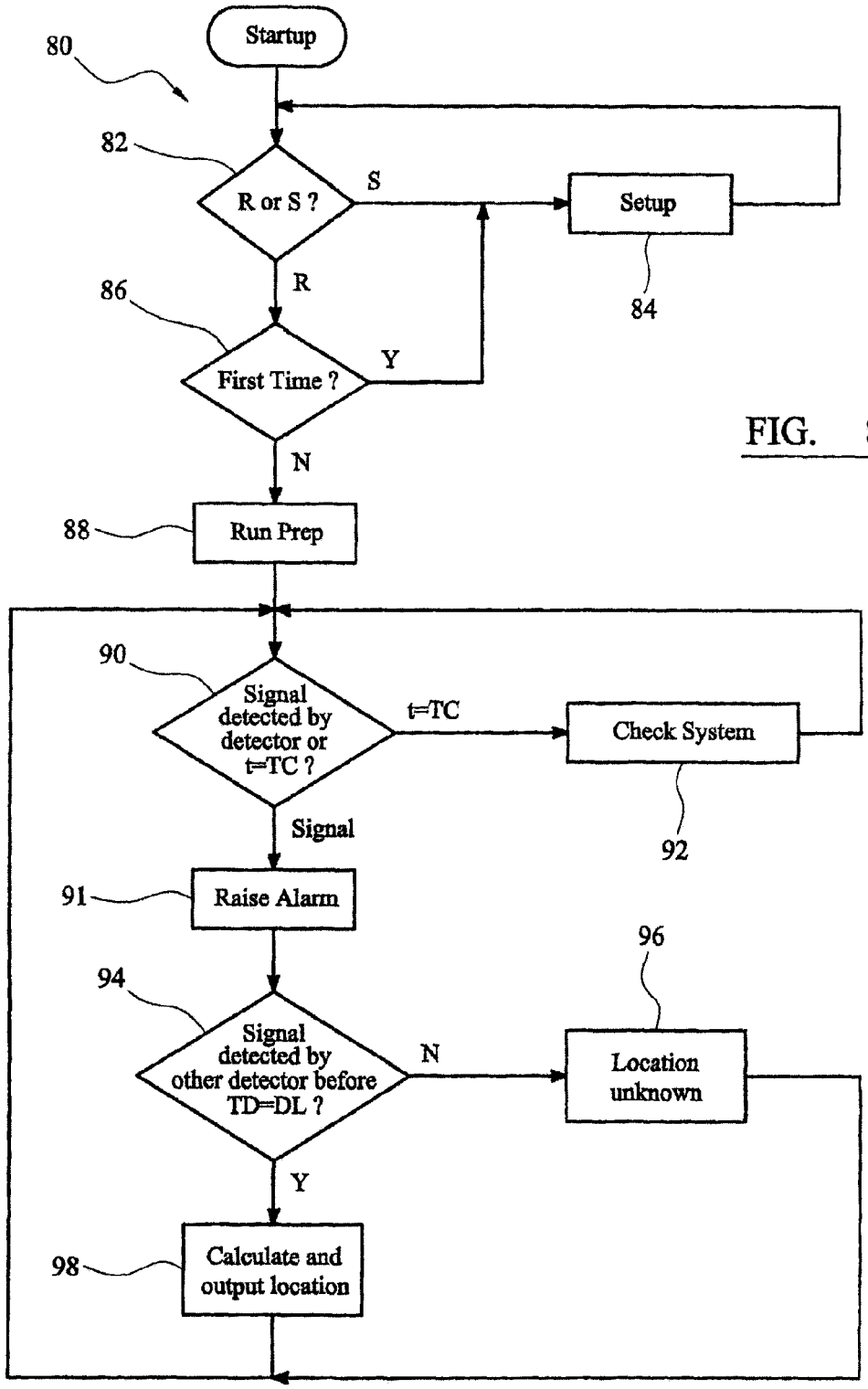
Figure 11:
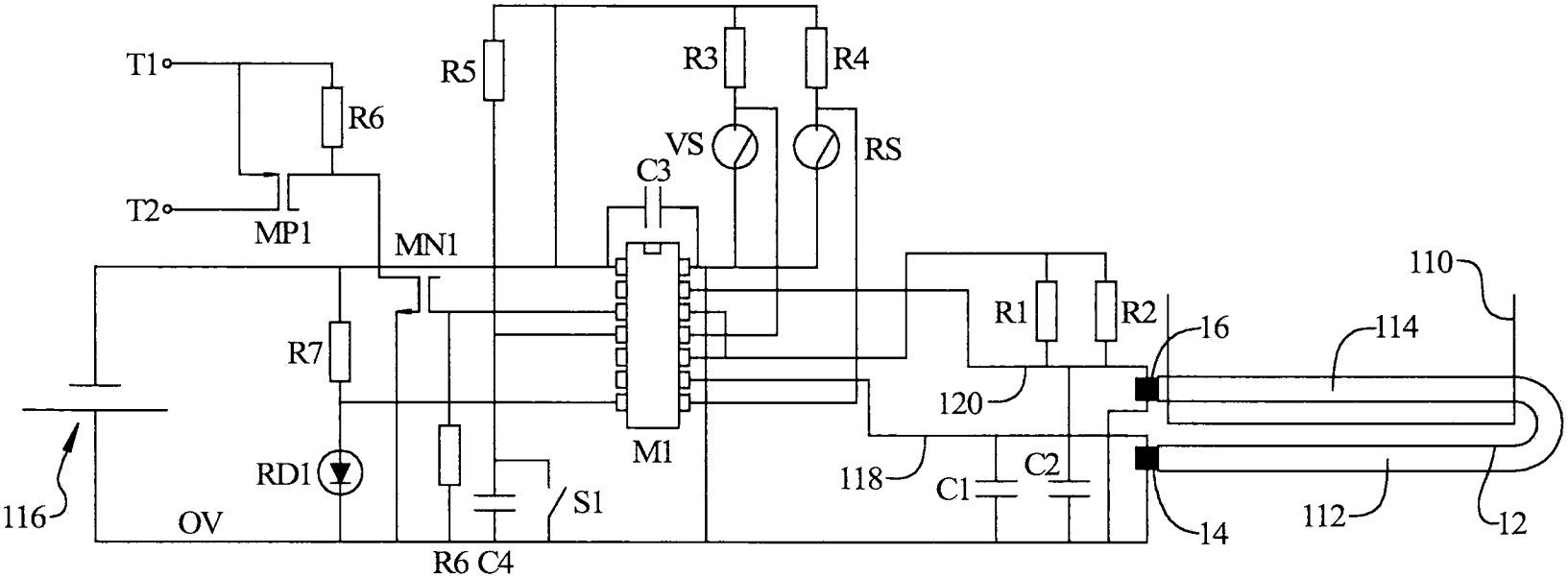
Figure 12:
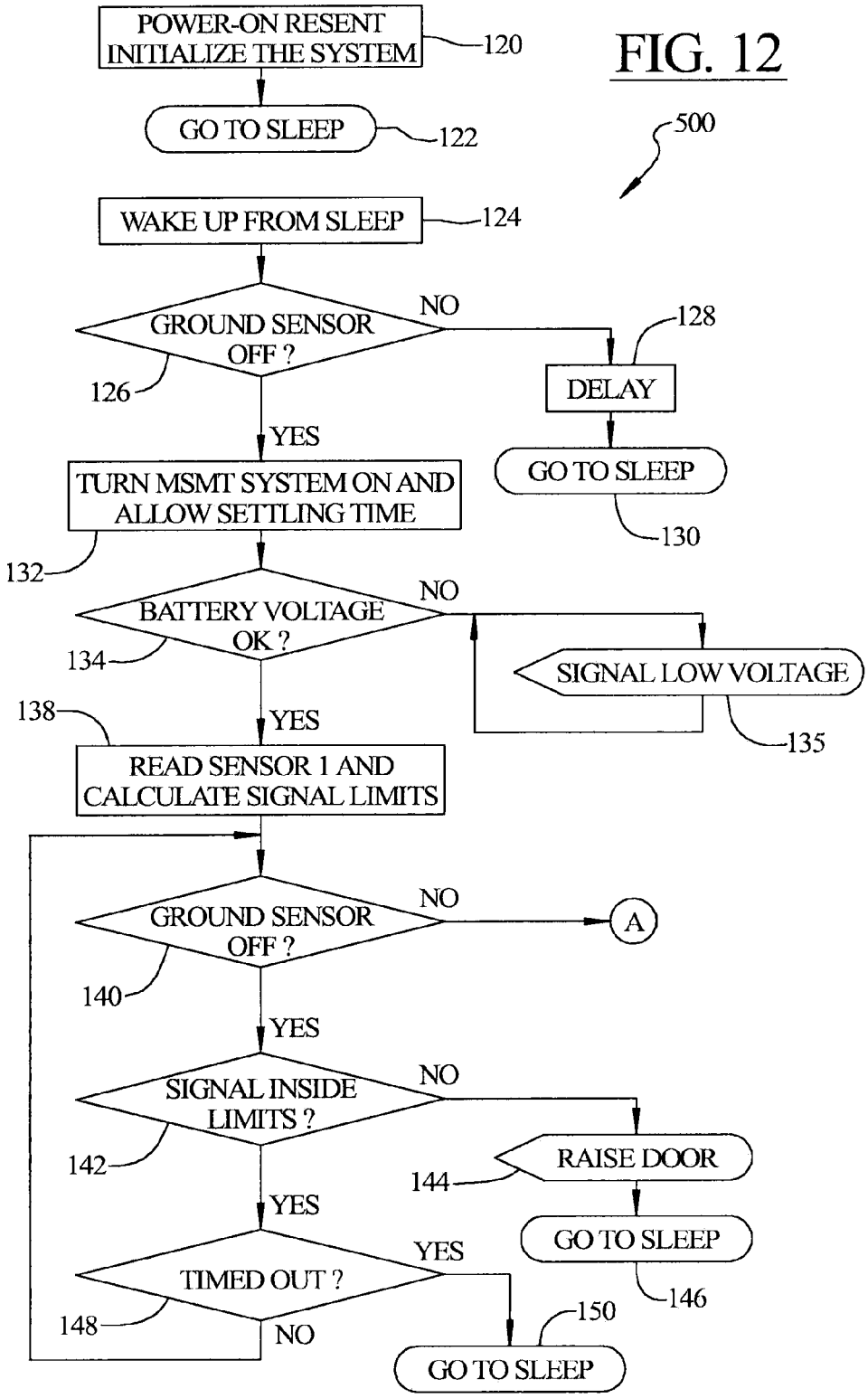

FIGS. 7(*a*) and 7(*b*) show circuit diagrams of the power supply for the first end system and the second end system of the safety system respectively;

FIG. 8 shows a flow chart illustrating an overview of the method of executing the safety system shown in FIG. 1;

FIG. 9 shows a schematic diagram of a garage door edge safety system in accordance with the present invention;

FIG. 10 shows the arrangement of the garage door safety system shown schematically in FIG. 9;

FIG. 11 shows a circuit diagram of the safety system shown in FIG. 9;

FIGS. 12 and 12A show a flow chart illustrating the control system of the garage door safety system shown in FIGS. 9 and 10 and an overview of the method of executing the safety system; and FIG. 13 illustrates the response of an acoustic chamber to a deformation.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows a schematic view of an embodiment of the safety system 10 of the invention. The safety system 10 generally comprises an elongate non-electric signal carrying device 12, a first detector 14 located at a first end of the signal carrying device 12 and a second detector 16 located at a second end of the signal carrying device 12.

The safety system 10 further comprises a testing device 18 which includes a speaker 20 that is in fluid communication with the signal carrying device 12 via a T-piece 22.

The signal carrying device 12 is a hollow tube containing a gaseous fluid. The gaseous fluid is air at about atmospheric pressure. The walls of the hollow tube 12 are made from a flexible and radially compressible rubber material that returns to its original shape once the force causing the hollow tube 12 to compress is removed.

Figure 2:
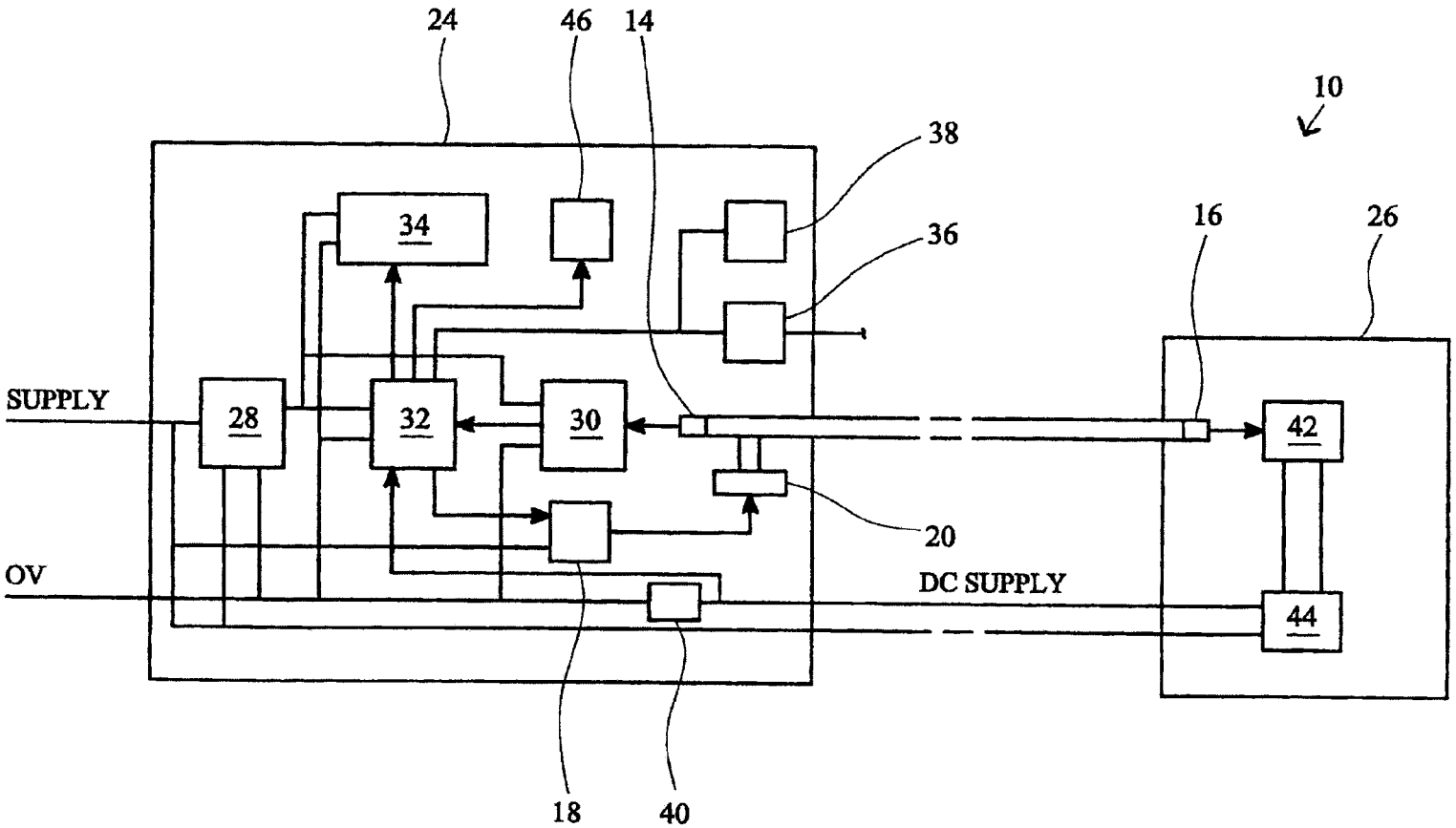
FIG. 2 shows a more detailed schematic diagram of the safety system shown in FIG. 1.

As illustrated in FIGS. 1 and 2, the safety system can be divided into a first end system 24 and a second end system 26. The first end system 24 includes the first detector 14 and the testing device 18. The second end system 26 includes the second detector 16.

The first end system 24 includes a power supply unit 28 which serves to create a smoothed regulated supply for the safety system from an external power supply. The first detector 14 is an acoustic pressure sensor, and in particular an electric microphone capable of detecting a pressure wave. The first detector 14 is operatively connected to an analogue-processing section 30 which is described in more detail below with reference to FIG. 3. The analogue-processing section 30 is operatively connected to a control unit 32 which controls the operation of the first end system 24.

The first end system 24 further comprises a liquid crystal display ("LCD") 34 which is used to output messages and signals to the system user. There is also provided a CCTV camera interface 36 which enables the control unit 32 to set or select the image of CCTV cameras to be displayed on the LCD display 34. A switch interface 38 is used to enable switches to be connected to the control unit 32 to enable the system to be set up at the time of installation or maintenance. In particular, the switch interface allows a switch to be connected to the safety system 10 which enables the safety system 10 to be set to either a run mode or a setup mode. The switch and camera 36, 38 interfaces will be described in more detail in relation to FIG. 6.

An audible alarm device 46 is operatively connected to the control unit 32 and is capable of outputting an audible alarm.

The first end system further comprises a resistor 40 to sense the current flowing to the second end system 26.

The LCD 34 comprises a standard 16-character×2-line display which incorporates a standard driver chip enabling simple interfacing to eight or 4-bt processors. In the embodiment shown, a 4-bit is used in order to reduce the number of input/output lines. Data has to be sent as 2 nibbles and can be command data (to set display conditions) or character data for display. However, as will be appreciated, any type of visual display unit can be used instead of LCD 34 for displaying messages to the user.

The second end system 26 includes the second detector 16. In the embodiment shown, the second detector 16 is an acoustic pressure sensor, and in particular an electric microphone capable of detecting a pressure wave. The second end system 26 also includes an analogue processing section 42 which is used in conjunction with the second detector 16 to detect a pressure wave and to switch in a load when a pressure wave is detected so that this condition can be detected at the first end system 24 via the supply current and current-sensing resistor 40. The second end system 26 further comprises a resistor 44 to produce a smooth regulated DC supply to the second end system 26.

Figure 3:
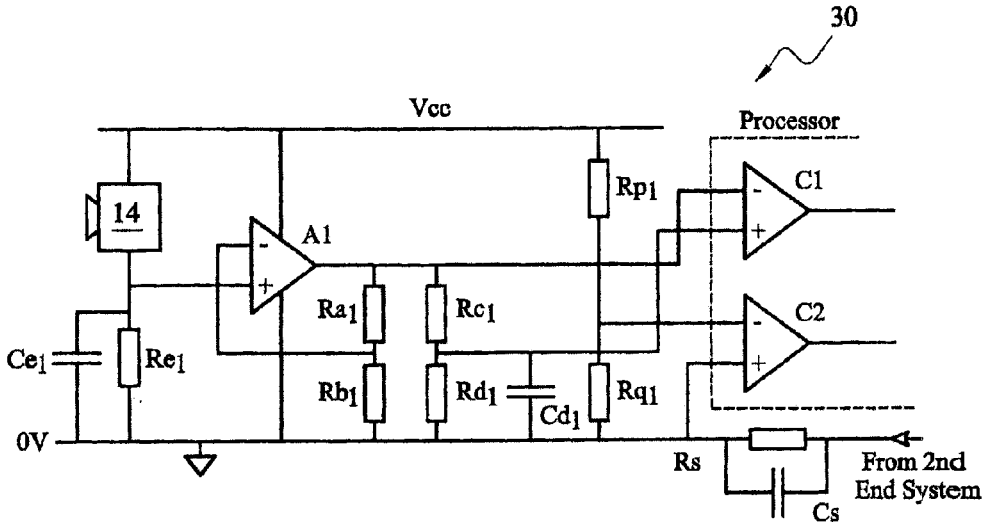
FIG. 3 shows a circuit diagram of a sensing and analogue processing component located at a first end of the non-electric signal carrying device of the safety system shown in FIG. 2.

With reference to FIG. 3, the analogue-processing section 30 of the first end system 24 will now be described in more detail. The acoustic pressure sensor 14 is powered from the Vcc supply and with a sensing resistor Re1 in the ground. The capacitor Ce1 creates a low-pass filter that is used to attenuate high-frequency acoustic signals, i.e. acoustic noise. The signal voltage across Re1 is amplified using a non-inverting amplifier created with the op-amp A1 and the resistors Ra1 and Rb1, which are used to set the gain. The DC level of the signal as well as the AC components are amplified and the values are chosen such that the DC level at the level at the output of A1 is about Vcc/2.

The output of the amplifier is fed to an input comparator C1. The other input of the comparator C1 is derived from the output of A1 after passing it through an attenuator formed from Rc1 and Rd1 which has a very low frequency response created by the addition of the capacitor Cd1. This is to create a reference voltage at the comparator C1 that is a fraction of the steady (DC) level of the signal so that as conditions change, e.g. as components change or temperature changes, the reference voltage at the comparator is always related to the average signal level. This has been found to give a better design than simply taking a fixed reference voltage. This is because the reference voltage is close to the steady-state signal of the amplifier output to minimize the time between the amplifier output starting to change due to a signal occurring and the comparator responding. Accordingly, the system is sensitive to small changes in the reference voltage and to small changes in the steady-state signal level. Problems can arise if a fixed reference voltage is used as small changes in the steady-state signal level can cause large errors.

The operation of the second end system 26, i.e. on detection of an acoustic pressure wave, causes the supply current to the second end system 26 to rise. This current is detected by the resistor 40 and the voltage across it is fed to a second comparator C2 within the processor of the analogue-processing section 30. The reference voltage for this comparator C2 is derived from the supply by means of the potential divider Rp1 and Rq1.

Figure 4:
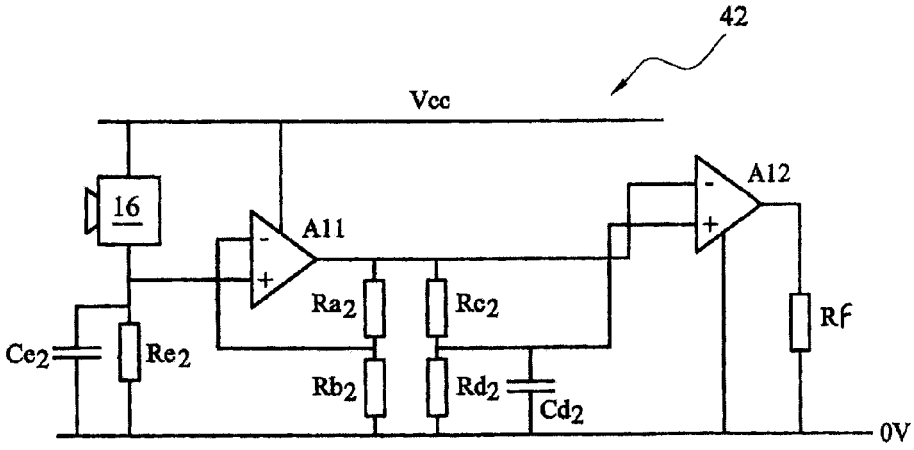
FIG. 4 shows a circuit diagram of a sensing and analogue processing component located at a second end of the signal carrying device of the safety system shown in FIG. 2.

With reference to FIG. 4, the analogue-processing section 42 of the second end system 26 will now be described in more detail.

The analogue-processing section 42 of the second end system 26 is almost identical to that of the first end system 24. However, the analogue-processing section 42 of the second end system 26 does not contain a processor. Therefore a comparator equivalent to the comparator C1 of the first end system has to be implemented. A dual op-amp (Af1 and Af2) is used as A1 and as C1 in the analogue-processing 42 of the second end system 26. The output of Af1 and Af2 is a resistor Rf to the 0V line so that when Af1 and Af2 operate, a significant increase in the power-supply current takes place which can be sensed at the first end system 24 via the sensing resistor 40.

Figure 5:
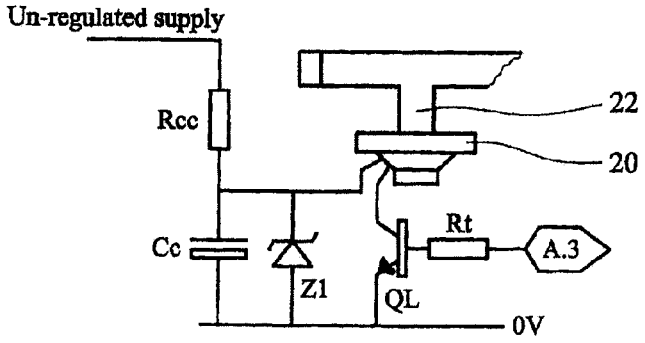
FIG. 5 shows a circuit diagram of a testing system of the safety system shown in FIG. 2.

The testing system 18 will now be described in more detail in relation to FIG. 5. The speaker 20 is used to send a short acoustic pressure wave down the tube via a T-piece conduit 22. The electrical pulse to the speaker 20 is created by charging a large capacitor Cc from the unregulated DC supply via a current-limiting resistor Rcc. The voltage on the capacitor is limited by the Zener diode Z1. The capacitor is discharged through the speaker 20 by using a transistor switch QL which is turned on by the processor line applied to the base of the transistor via the resistor Rt.

Figure 6:
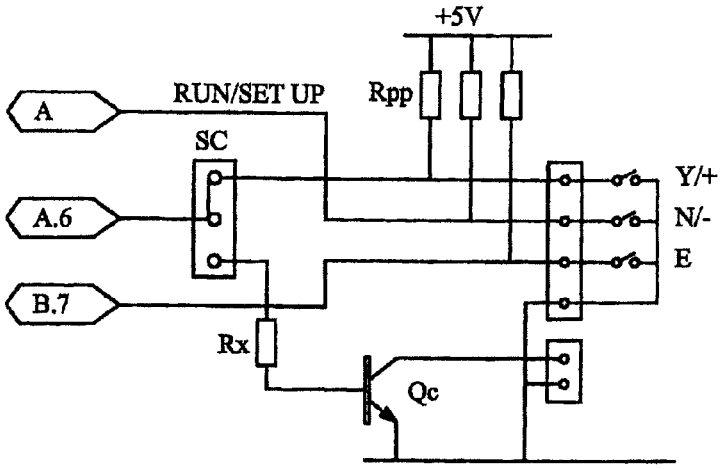
FIG. 6 shows a circuit diagram of the switching and camera interface component of the safety system shown in FIG. 2.

With reference to FIG. 6, the switch and camera interfaces 36, 38 will now be described in more detail. During the setting up of the safety system 10, the switch SC can be operated to select the upper connection and the three control lines are set to input. The pull-up resistors Rp ensure that the inputs are normally high and the operation of a switch pulls the line low. These three switches are sufficient to enable a user to set the system up with switches functioning as "yes" or "increment" (Y/+), "no" or "decrement" (N/−) and "accept".

In running the safety system, the switch SC can be operated to select the lower connection, and the control line A.6 is set as an output. Camera selection control is operated by pulsing this line with the transistor acting as a shorting switch. The other two control lines could be used to make a direct camera selection if the camera hardware permitted this and thus one of up to eight cameras could be selected.

The power supply units of the first end system 24 and the second end system 26 will now be described with reference to FIGS. 7(*a*) and 7(*b*) respectively.

With reference to FIG. 7(*a*) the first end system 24 is powered from a plug-top AC-to-DC unit giving an output of about 16 V. The power supply unit 28 consists of a filter L1, L2, and Cf to filter hf transients followed by a 5V regulator Reg 1. 100 nF. capacitors Cf and Cg and a 100 FF electrolytic capacitor Ch.

With reference to FIG. 7(*b*), the second end system 26 receives a high regulated power supply via a blocking diode D1 used to prevent reserve polarity being applied. The regulator Reg2 is a low quiescent current device with 100 mF input and output capacitor and 100 mF electrolytic output capacitor.

The control unit 32 is the 16F873a microcontroller available from Microchip Technologies Inc. The microprogrammer is reprogrammable and incorporates the security feature to prevent the program from being copied.

A method of operating the safety system 10 will now be described with reference to FIG. 8.

After turning the safety system 10 on, the control unit 32 determines at step 82 whether a control switch (not shown) is set to run ("R") or setup ("S").

If the control switch is set to setup ("S"), then the system runs the setup routines at step 84. These routines include entering into the system via an input switch (not shown) connected to the switch interface 38, a number of parameters.

In the embodiment shown, the input switch is a 3-switch installation unit which allows a user's response/command to questions displayed by the LCD unit to be entered. The 3 switches allow the user to enter the response/command: "Yes" or "increment" by pressing a first switch; "No" or "decrement" by pressing a second switch; and "Accept" or "enter" by pressing the third switch.

The parameters entered into the safety system 10 during the setup routine include: the distance "L" between the first 14 and second 16 detectors, which in this case is the length of the tube 12; the time interval at which system checks are to be made (the check time interval ("TC")); the expected time difference ("ETD") between the first and second sensors detecting a pressure wave during a test routine; the maximum time limit (DL) that the control unit waits for between one of the detectors 14, 16 detecting a signal and the other detector 14, 16 detecting the signal during normal operation; and the number and boundary location of CCTV cameras (if included as part of the safety system).

The setup routine also includes the step of setting up the speaker 20 series resistor which controls the amplitude of the pressure wave generated by the speaker. The series resistor is initially set to have no resistance. The appropriate value of the series resistor depends on the length of the tube 12. If the series resistance is below the value appropriate for the length of the tube 12, then the amplitude of the pressure wave generated by the speaker 20 will be undesirably large and can cause spurious signals to arise from acoustic reflections. If the series resistance is above the value appropriate for the length of the tube 12, then the amplitude of the pressure wave generated by the speaker 20 will be undesirably small and one or both of the detectors 14, 16 will not detect the pressure wave.

The appropriate speaker's series resistance is determined by pulsing the speaker 20 to generate a pressure wave. The length of the tube 12 is then displayed on the LCD 34 with a recommended value of series resistance for the speaker 20. The system then allows for a re-test after a resistor with the recommended resistance has been inserted in the speaker 20 line so that it can be confirmed that spurious acoustic reflections are not a problem.

After the series resistance has been changed, a final speaker pulse test is executed to verify that there are no reflections. If reflections have been detected, the user will be prompted to raise the value of R. If no reflections have been detected the system will indicate OK and the system is ready to run. If the resistance is too high it could cause one or both of the detectors to fail to operate. In this case, the LCD 34 will display "Fault b". The user can then reduce the resistor value as appropriate.

If at step 82, the control switch is set to run ("R"), then the system determines at step 86 whether this is the first time the system has been run and whether the setup routine has previously been performed. If it determines that this the first time that the system has been run and that a setup routine has not previously been performed, then control proceeds to step 84 at which the setup routines are run. If it is not the first time that the system has been run or if the setup routine has previously been performed, then control proceeds to step 88 at which the system sets the conditions ready for the system to run.

Once the system is running, control proceeds to a waiting loop at step 90 which waits until one of two possible events. These events are either (i) the detection of a signal by either the first end system 24 or the second end system 26, or (ii) if a check timing interval is reached. The check timing interval is reached when an interval clock counter "T" in the control unit 32 reaches the preset value TC. i.e. when time T=TC.

If the event at step 90 is that the check timing interval has been reached, i.e. if T=TC, then the check routines are performed in step 94 to verify the integrity of the system. In the embodiment shown, the check routines involve the testing system 18 operating the speaker 20 to create an acoustic pressure wave in the tube 12 so as to simulate the tube being compressed. The first 14 and second 16 detectors detect the pressure wave once it has reached the respective ends of the tube 12.

The check routine involves the control unit 32 measuring the time interval between the detection of the signals by each of the first 14 and second 16 detectors, and compares the measured time with the ETD stored during the set up routine. If the time measured is within a small tolerance of the ETD, i.e. within +/−6.25% of the ETD, then the check is accepted and it is determined that the safety system is functioning properly. If the time measured is shorter than the ETD, then it is assumed that the tube 12 has been pressed at or close to the same time as the check routine being performed, and therefore determines than an alarm is being raised. In this case, the control unit 32 outputs a signal to the alarm 46 to raise an audible alarm. The control unit 32 also outputs a signal to the LCD 34 so that it displays a message indicating that the location of the alarm is unknown. If the time measured is longer than the ETD, then the control unit 32 raises a fault alarm. The control unit 32 can do this by outputting a signal to the alarm 46 to raise an audible alarm, and/or output a signal to the LCD 34 so that it displays a message indicating that the safety system is faulty. Preferably the audible alarm output by the alarm 46 to signal a system fault is different to the audible alarm output when raising an alarm (in response to the being pressed). For example, the audible alarm output by the alarm 46 to signal a system fault have a different tone, pitch, or amplitude than the audible alarm output when raising an alarm. Upon completion of the check routines, the control unit resets the interval clock counter "T" to 0.

If in step 90, the event is a signal detected by either of the first 14 or second 16 detectors, then, at step 91, the control unit 32 immediately outputs a signal to the alarm 46 to raise an audible alarm. Then, at step 94, the control unit 32 waits for the signal to be detected by the other detector. In doing so the control unit measures the time ("TD") between the signal being detected by the detector that first detected the signal and the signal being detected by the other detector. If the signal is not detected by the second detector within the preset maximum time limit (DL), then the location of the point at which the signal originated from, and therefore the point at which the tube 12 was pressed, cannot be determined. In this case, control proceeds to step 96 where the control unit 32 outputs a signal to the LCD 34 so that the LCD displays that the location of the press is unknown.

If at step 94, the signal is detected by the other detector before the preset maximum time limit (DL), then control proceeds to step 98 where the control unit 32 calculates the location of the origin of the signal, and therefore the point at which the tube 12 was pressed. The method of calculating the origin of the signal is described in more detail below. The control unit 32 then outputs a signal to the LCD 34 so that the LCD displays the location at which the tube 12 was pressed. The location displayed by the LCD can be any type of indication which enables the user to determine where the tube was pressed. For example, the location displayed can be a number which indicates the distance along the tube 12, taken from the first end system 24 at which the tube was pressed.

Alternatively, the tube 12 could be conceptually be broken into a number of sections, e.g. A, B, C and D. The boundaries of these sections could be entered into the control unit 32 during the setup routines 84. Therefore, the control unit 32 could calculate the location of the origin of the signal, and then determine within which section the tube was pressed. The signal output by the control unit 32 to the LCD 34 could then control the LCD so that it displays, for example "section A".

Further still, if the LCD is capable of displaying graphics and the safety system contains a map of the areas within which the tube is located, then the display could indicate on the map in which area the tube was pressed by highlighting that area.

The method of calculating the origin of the signal and therefore the point at which the tube 12 is pressed, will now be described in more detail with reference to FIG. 1. When the tube 12 is pressed, for example at point P, then a pressure wave is created which propagates through the tube 12 at the speed of sound to each end of the tube. As the first 14 and second 16 detectors are placed at each end of the tube 12, then the arrival of the wave can be detected at each end, and the difference in time between the arrival at the two ends can be measured by the control unit 32. This can be done by beginning a timer within the control unit 32 upon detection of the pressure wave by one of the detectors 14, 16 and then stopping the timer when the pressure wave is detected by the other detector. In the embodiment shown, the distance between the first 14 and second 16 detectors is known, and is equal to the length L of the tube 12. Also, the speed at which the pressure wave travels through the tube 12 is known as a pressure wave travels through air at atmospheric pressure at the speed of sound. The speed at which sound travels through air at 0° C. is 331.4 m per second and increases at 0.6 m per second per whole ° C. rise. In the embodiment shown, it is assumed that the air is at 20° C. and therefore it is assumed that the pressure wave travels through the tube 12 at a speed of 343 m per second. In other embodiments, the temperature of the air within the tube 12 can be measured by a thermometer connected to the tube, in order to more accurately determine the speed at which the pressure wave will travel through the tube 12.

The time "t1" that it will take for the pressure wave to propagate from the press point to the first end detector 14 is: x/v, where x is the distance between the press point P and the first end detector 14, and where v is the speed of sound. The time "t2" that it will take for the pressure wave to propagate from P to the second end detector 16 is therefore: (L−x)/v. The difference in arrival time of the signal at the first end detector 14 and the second end detector 16 is thus: t1−t2 or [x/v−(L−x/v)], assuming that the point P is nearer the second end detector 16 than the first detector 14. If "T1" is the time difference measured, then rearranging these formulae gives x=L/2+(T1.*v*)/2. If the point P is nearer the first end detector 14 than the second end detector 16 then the distance x=L/2−(T1.*v*)/2.

Therefore, determining the distance from the first end system 14 at which the tube 12 has been pressed requires a measurement of the time difference T1 and the distance between the first end 14 and second end 16 detectors L. To avoid having to physically measure the length L and enter into the calculations, it can be derived from a similar measurement of a pressure wave set up for calibration purposes. If the pressure wave is set up at one end then the time to reach the far end will be L/v. Thus, the measurement can be formed indirectly by another time measurement. After a calibration time measurement has been made (to determine L) a signal time interval measurement can be used to identify the location at which the tube has been pressed.

In the embodiment described all time measurements are made by a timer within the control unit 32. The control unit 32 has a 16-bit counter which can be used to count a clock pulse from an internal or external source. In this embodiment, the clock is derived from the microprocessor clock after dividing it by 8. The microprocessor has a 4 MHz oscillator from which it derives a 1 Mhz system clock. Therefore the timer counts increments of 8 seconds with a maximum count of 216 making a maximum measuring time of 0.524288 seconds with a resolution of 8 seconds.

The timer used can be stopped, started and cleared by the control unit 32, but once started it is not effected by other operations to the control unit. The accuracy of the timer is set by the accuracy of the microprocessor clock which is internally set. The microprocessor clock is a crystal-controlled oscillator (4 MHz) from which it derives a 1 Mhz system clock.

Errors in the time measurement for location and length measurement can be caused by the delay in the comparators of the detectors responding to the pressure wave. The level at which the comparators respond has to be set significantly different to (below) the steady-state level to avoid spurious triggering on acoustic or electrical noise. This means that there is a finite time delay between the wave front of the pressure wave in the tube arriving at a detector and at reaching a sufficient level to trigger the comparator. This rise delay will increase as the tube length increase because of dispersion and attenuation of the wave. In order to overcome this problem, a compensating term can be introduced which deducts a small portion of the time measured to give a length-dependant effect.

Another error in the time measurement for location and length measurement can be caused by the signal amplitudes at each end of the tube being different. This is particularly the case if the tube is pressed nearer one end of the tube than the other as the signal that reaches the detector at the end of the tube far from the press point will have attenuated by a larger amount than the pressure wave reaching the detector at the end closer to the press point. The comparison voltage at the comparator is a proportion of the DC level which is approximately the same for each end. Thus a signal of smaller amplitude takes longer to rise to a fixed voltage than one with a larger amplitude. Accordingly, this will mean that the pressure wave will have actually reached the detector sometime before the detector actually signals and detects that the pressure wave has arrived.

An alternative way of overcoming this disadvantage could be to eliminate these comparators and digitize the pressure signals as they appear. Digital signaling processing can then be applied to compensate for amplitude differences and obtain more accurate measurements of the differential times.

Another way of overcoming this disadvantage is to use a second pair of comparators operating at a different voltage to compensate for amplitude differences. If the signals have a constant slope, then any difference in time of the response is from a pair of comparators at each end of the tube could be used for amplitude differences.

FIG. 9 shows a schematic view of an embodiment of the safety system 10 of the invention in the form of a garage door edge safety system. The safety system 10 generally comprises an elongate non-electric signal carrying device 12, a first detector 14 located at a first end of the signal carrying device 12 and a second detector 16 located at a second end of the signal carrying device 12. The safety system can be divided into a first end system 24 and a second end system 26. The first end system 24 includes the first detector 14. The second end system 26 includes the second detector 16.

The signal carrying device 12 is a hollow tube containing a gaseous fluid. The gaseous fluid is air at about atmospheric pressure. The walls of the hollow tube 12 are made from a flexible and radially compressible rubber material that returns to its original shape once the force causing the hollow tube 12 to compress is removed.

With reference to FIGS. 10 and 11, a control system 500 for processing signals derived from detectors 14 and 16 in the garage door edge safety system illustrated in FIG. 9 will now be described. Detectors 14 and 16 comprise a pair of acoustic sensors mounted at or towards the ends of the signal carrying device 12.

The signal carrying device 12 is mounted within the bottom of a garage door 110 such that a first arm 112 of the signal carrying device 12 is located across the bottom edge of the door 110 and a second arm 114 of the signal carrying device 12 is located entirely within the door 110. Consequently, the first arm 112 is subject to contact with other objects such as the ground or an object such as a vehicle obstructing the door 110 as the door 110 closes. When the first arm 112 contacts another object, it is deformed creating a signal within the signal carrying device 12 which may be detected by detectors 14 and 16 in the same way as described above for embodiments of the present invention relating to an alarm system. The second arm 114 is not subject to deformation by contact with other objects as it is entirely enclosed within, and protected by, the door 110.

The second detector 16 is provided to enable a check to be made on the integrity of the signal carrying device 12, for instance in order to detect damage to the signal carrying device 12 such as a cut or a blockage. This integrity check is performed by first examining the signal from the first detector 14 when the door 110 contacts the ground.

In this embodiment, the control system 500 is inside the door. In other embodiments the control system may be mounted on the door 110. The control system 500 illustrated in FIG. 11 incorporates a microprocessor M1. The system 500 further includes a separate door closure sensor RS which is arranged to provide a signal to the microprocessor M1 when the door 110 is close to its fully closed position. The sensor RS may be conventional in construction and so will not be further described in detail here. For example, RS may be a magnet on the door frame that activates the reed switch on the board enclosed in the item 500 or it could be any other device that switches the mode at that preset point (such as a limit switch situated on the lower edge of the garage door 110 that connects with the floor before the signal carrying device 12 touches the ground).

Sensor RS is supplied by from the voltage supply from battery 116 via resistor R4. When sensor RS detects that the door 110 is close to the ground then a switch within sensor RS is closed, such that a change in voltage level at the junction between resistor R4 and sensor RS is input to microprocessor M1.

When sensor RS indicates that the door 110 is close to the ground the signal from detector 14 is monitored. When the door 110 contacts the ground a large signal is generated within the signal carrying device 12 as a significant proportion of the first arm 112 is subject to a deformation by being compressed between the door 110 and the ground. If detector 14 detects a large signal from the first arm 112 of the signal carrying device 12 within a predetermined time interval then the signal from detector 16 is monitored to verify that the second detector also occurs within a predetermined time interval. If either detector signal is not detected then a fault is flagged by the microprocessor M1. This system integrity check is performed each time the door 110 is fully closed.

As described above, any deformation of the signal carrying device 12 causes a pressure change within device 12 which can be detected by the detectors 14, 16. The sensed pressure change is converted to an electrical signal by sensing resistors R1, R2 which are connected between a terminal of microprocessor M1 and a respective detector terminal. Detectors 14 and 16 comprise resistive elements, the resistance of which varies according to the detected pressure within the signal carrying device. A second terminal of each detector 14, 16 is connected to the ground terminal of the battery 116 completing the circuit. Thus, a change in pressure within the signal carrying device 12 causes the voltage at the junction between each detector 14, 16 and the respective sensing resistor R1, R2 to vary. The change in voltage is sensed by microprocessor M1, via sensing inputs 118, 120. Capacitors C1, C2 in combination with sensing resistors R1, R2 form low-pass filters which serve to attenuate high-frequency acoustic noise signals within the signal carrying device 12. Microprocessor M1 measures sensed changes in the detector outputs.

The microprocessor M1 is powered by battery 116. In order reduce battery consumption the microprocessor M1 can be put into a "sleep" mode when it is not in use. The system is only required to operate when door 110 is moving. In order to detect when door 110 is moving the system uses a vibration sensor VS. Vibration sensor Vs is connected between the positive battery terminal and ground. The connection to the battery 116 is via resistor R3. The voltage at the junction between resistor R3 and the vibration sensor VS is provided to an input of microprocessor M1. When vibration is detected the vibration sensor switch closes such that a change in voltage between resistor R3 and vibration sensor VS can be detected. Upon detection of this change in voltage the microprocessor exits the sleep mode. As the electrical supply to the detectors 14, 16 is derived from a terminal of the microprocessor M1, the detectors are also disabled during sleep mode.

In normal operation, a significant change in the signal supplied to the microprocessor M1 from detector 14 (caused by the door 110 hitting an object) can be detected by microprocessor M1. Upon detection of this signal the microprocessor M1 provides an output signal to the gate of transistor MN1. Complementary MOS transistors MN1 and MP1 with resistors R6 and R8 form a switch. The output signal supplied to the gate of transistor MN1 causes transistor MP1 to be switched such that current can pass between terminals T1 and T2. Terminals T1 and T2 are connected to a radio transmitter (not shown) which is arranged send a radio signal to a garage door controller (not shown) instructing the garage door controller to open the door due to an obstruction having been encountered.

As discussed above, switch RS is provided in order to detect when the door is close to being fully closed. When switch RS operates the microprocessor will not provide the output signal to transistor MN1 when the large signal from detectors 14 and 16 are received as these correspond to the door 110 reaching the fully closed position.

In order to provide fault protection reference diode RD1 enables the supply voltage to be monitored indirectly to provide low-voltage protection. Reference diode is connected to the voltage supply via resistor R7 and to ground. If the voltage supply does not exceed the reference voltage of reference diode RD1 then no current will flow through reference diode RD1, which is detected by an input to the microprocessor. Each time the system is switched on the battery voltage is checked. Capacitor C3 and C4, together with resistor R5 form a low pass filter which serves to filter out any high frequency components of the voltage supply which could otherwise interfere with the system.

A method of operating the garage door control system of FIGS. 9 to 11 will now be described with reference to the flow chart of FIGS. 12, 12A.

At step 120 the control system 500 is powered on and the microprocessor is initialized. At step 122 the control system enters the sleep mode.

At step 124 if the microprocessor detects a signal from the vibration sensor VS the control system wakes from the sleep mode. At step 126 the microprocessor checks to see whether the signal from door closure sensor RS is off. If the signal from the door closure sensor is not off (that is the system is close to, or fully closed) then the processing passes to step 128. At step 128 the system enters a short delay. The system enters the sleep mode again at step 130.

If at step 126 the door closure sensor RS indicates that the door is not closed then at step 132 the detector monitoring system is turned fully on and the system waits for a short settling time.

At step 134 the battery voltage is checked by measuring the voltage between reference diode RD1 and resistor R7. If the battery voltage is not OK then the system provides a fault alert output at step 136 and further processing is suspended.

If the battery voltage is OK then at step 138 the signal from the first detector (detector 14) is measured and the limits are set within which the detector output is determined to indicate that an object has been hit by the door. The system then enters a loop within which the output of detector 14 is continuously monitored.

At step 140 a check is made as to whether the ground sensor RS is off. If the ground sensor RS is not off (that is, the door is close to, or fully closed) then the processing passes to the system integrity check described below. However, if the ground sensor is off then at step 142 a check is made as to whether the signal from detector 14 is within the previously determined limits. If the detector output exceeds these limits then it is determined that the door has hit an obstruction and at step 144 the door is raised. At step 146 the system enters the sleep mode.

If at step 142 it is determined that the detector 14 output is within the previously determined limits then at step 148 the system checks to see whether the time for which the detector output remains within the limits has exceeded a predetermined time out period. If the time out period has expired without the detector 14 output exceeding the predetermined limits then at step 150 the system enters the sleep mode. Otherwise, processing returns to step 140 and the ground sensor RS output is rechecked.

If the ground sensor RS output at step 140 indicates that the door 110 is close to or fully closed then the system enters the system integrity check. At step 152 the output from detector 14 is checked to see if it is within predetermined limits. If the output is within predetermined limits then at step 154 a check is made to see whether the output has remained within the predetermined limits for longer than a predetermined time out period. If so then the microprocessor provides a fault output at step 156. If not then the output from detector 14 is rechecked at step 152.

If at step 152 the output from detector 14 is determined not to be within normal limits then at step 158 the output from detector 16 is checked. If a signal is detected from detector 16 then it can be determined that the door is fully closed and the system enters the sleep mode at step 160. If not, then the microprocessor provides a fault signal at step 162.

EXAMPLE

Testing of the Acoustic Chamber

In a preferred embodiment, the system according to the present invention relies on the sensing of dynamic pressure in the closed space of an enclosure which is subject to mechanical deformation caused by either a moving object hitting the stationary enclosure or a by the moving enclosure hitting a stationary object. The dynamic deformation of the enclosure causes pressure variations of air within the enclosure which are sensed by an electric microphone system. Noise-cancelling microphones are used to eliminate external acoustic signals leaving the system sensitive to the internal pressure within the enclosure.

FIG. 13 shows a typical response of the enclosure. The quiescent signal level changes as an increase in pressure is caused by a press and then falls as a decrease in pressure is caused by release. It then recovers to its quiescent level. The deviation from the quiescent level can be detected and used to sense deformation of the enclosure. The shape of the signal depends upon the nature of the deformation and the shape of the enclosure, together with factors associated with the propagation of acoustic signals.

Using the enclosure to monitor pressure changes, it is possible to look for a deviation from the norm which may arise for a number of reasons.

For example, the enclosure may be mounted on the leading edge of a garage door (to form a garage door edge safety system) which moves from open to closed. The signal will have a quiescent value until an obstacle is struck or the door reaches the closed position (causing the safety edge to compress) when a deviation from the quiescent value can be measured in size and time. Decompression of the safety edge can also be detected. One such decompression may arise from the outer weather seals of a garage door slipping on an obstructing object on closure and allowing the safety edge chamber to momentarily decompress. This is useful as sometimes the decompression signal is (depending on the profile of safety edge) the most significant deviation in the initial detection of an obstruction.

In addition to the deviation from the quiescent value, it is useful to look for the required signal map to detect the specific signal required. This may involve a time of deviation or possibly a unique scale of deviation.

Such applications for a scale of deviation could be a component breaking where the signal is large and short i.e. a metal comb of an escalator or similar device where the background signals could vary quite significantly.

The flexibility of programming the system to look only for the required signal or signal combinations allows almost unprecedented scope of application. Due to this benefit the present invention can be extremely sensitive and yet not prone to interference that usually accompanies sensitivity.

What is claimed is:

1. A safety system comprising:

an elongate signal carrying device including a wave carrying hollow tube with a first end and a second end and a fluid therein, at least a part of the hollow tube being manipulable at a manipulation point to generate a measurable non-electric acoustic signal that can be carried by the hollow tube;

an acoustic microphone detector for detecting the non-electric acoustic signal, the acoustic microphone detector outputting a detector output signal representing the non-electric acoustic signal;

a detector processing device that processes the detector output signal to detect a quiescent level of the detector output signal and to detect deviations from the quiescent level indicative of positive or negative changes in pressure in the fluid of the hollow tube, the detector processing device including a low pass filter that filters the detector output signal to remove a background non-electric signal therefrom, the detector processing device outputting a detector processing device output signal; and an output device operatively connected to the detector processing device for causing an audible alarm signal, a visible alarm signal or an electric signal to be output in response to the detector processing device output signal.

2. A safety system according to claim 1 in which the signal carrying device is static and is manipulable by a dynamic object.

3. A safety system according to claim 1 in which the signal carrying device is dynamic and is manipulable by a static object.

4. A safety system according to claim 1 wherein the output device causes an audible alarm signal or a visible alarm signal to be output in response to the detector processing device output signal.

5. A safety system according to claim 1 wherein the output device causes an electric signal to be output in response to the detector processing device output signal.

6. A safety system according to claim 5 wherein the hollow tube is mountable on an edge of a motor-driven garage door and the electric signal causes the motor to reverse, to stop or to adopt low voltage operation.

7. A safety system according to claim 2 wherein in use the non-electric acoustic signal is generated by a user selectively manipulating the manipulation point.

8. A safety system according to claim 3 wherein in use the non-electric acoustic signal is generated by a floor or obstruction manipulating the manipulation point.

9. A safety system according to claim 1, in which at least a part of the hollow tube is compressible to generate the measurable non-electric acoustic signal.

10. A safety system according to claim 1, in which the acoustic microphone is located at the first end of the hollow tube.

11. A safety system according to claim 1 further comprising:

a positioning system for determining the position of the manipulation point.

12. A safety system according to claim 11, in which the positioning system comprises:

a first detector for detecting the non-electric acoustic signal located at the first end of the hollow tube; and a second detector for detecting the non-electric acoustic signal located at the second end of the hollow tube.

13. A safety system according to claim 1 further comprising:

a testing system capable of testing the safety system.

14. A safety system according to claim 13, in which the testing system comprises a test signal generating device capable of generating a measurable non-electric test signal that is carried by the hollow tube.

15. A safety system according to claim 14, in which the test signal generating device comprises a manipulating device for mechanically manipulating the hollow tube.

16. A safety system according to claim 14, in which the test signal generating device comprises an inducing device for inducing a non-electric test signal in the hollow tube.

17. A safety system according to claim 1 further comprising:

a visual monitoring system operatively connected to the output device, wherein the visual monitoring system comprises:

at least one camera device capable of generating an image of at least a part of the signal carrying device; and a visual display unit on which the image from the or each camera device can be displayed in response to the non-electric acoustic signal.

18. A safety system according to claim 17, in which the visual monitoring system comprises:

at least two camera devices, each camera device capable of generating an image of a different part of the signal carrying device wherein the image generated by at least one of the camera devices is an image of the manipulation point.

19. A safety system according to claim 1, further comprising a spraying device for spraying a substance in response to the detector processing device output signal.

20. A safety system according to claim 19, in which the substance is a dye.

21. A safety system according to claim 19, further comprising a motion detector for detecting the locality of a moving body, and causing the spraying device to spray the substance in the locality.

22. A safety system according to claim 1, wherein:

the hollow tube includes a first manipulation point and a second manipulation point; and the measurable non-electric acoustic signal includes a first measurable non-electric acoustic signal and a second measurable non-electric acoustic signal;

wherein the output device is adapted to cause a primer signal to be output in response to the first measurable non-electric acoustic signal generated by the manipulation of the first manipulation point.

23. A safety system according to claim 22, wherein when the second measurable non-electric acoustic signal is generated within a preselected time after the first measurable non-electric acoustic signal, the alarm signal is different from the primer signal.

24. A method for operating a safety system comprising:

manipulating an elongate non-electric signal carrying hollow tube with a fluid therein at a manipulation point to generate a measurable non-electric acoustic signal in the hollow tube;

detecting the acoustic signal with an acoustic microphone;

outputting a detector output signal representing the non-electric acoustic signal from the acoustic microphone;

filtering the detector output signal with a low pass filter to remove a background non-electric signal therefrom;

processing the detector output signal to detect deviations from the quiescent level indicative of positive or negative changes in pressure in the fluid of the hollow tube;

outputting a detector processing device output signal representing the filtered and processed detector output signal;

outputting an audible alarm signal, a visible alarm signal or an electric signal with an output device in response to the detector processing device output signal.

25. A method according to claim 24, wherein the step of manipulating the signal carrying device comprises:

compressing the hollow tube.

26. A method according to claim 25, wherein the step of compressing the hollow tube comprises:

radially compressing the hollow tube.

27. A method according to claim 24, further comprising:

generating a controlled non-electric acoustic signal to test the safety system.

28. A method according to claim 24, wherein:

the hollow tube includes a first manipulation point and a second manipulation point; and the measurable non-electric acoustic signal includes a first measurable non-electric acoustic signal and a second measurable non-electric acoustic signal;

the method further comprising manipulating the hollow tube at the first manipulation point to generate the first measurable non-electric acoustic signal thereby causing the output device to cause a primer signal to be output in response to the first non-electric acoustic signal.

29. A movable garage door system that comprises a garage door with a leading edge which in a closed position contacts the ground, wherein a signal carrying hollow tube is mounted on the leading edge, the signal carrying hollow tube having a first end and a second end and a fluid therein, at least a part of the hollow tube being manipulable at a manipulating point to generate a measurable non-electric acoustic signal that can be carried by the signal carrying hollow tube, the garage door system also comprising an acoustic microphone that detects the acoustic signal and that outputs a detector output signal representing the non-electric acoustic signal, the garage door system further comprising a detector processing device that processes the detector output signal to detect a quiescent level of the detector output signal and to detect deviations from the quiescent level indicative of positive or negative changes in pressure in the fluid of the hollow tube, the detector processing device including a low pass filter that filters the detector output signal to remove a background non-electric signal therefrom.

30. A movable garage door edge safety assembly comprising:

a movable garage door having a leading edge which in a closed position contacts the ground, wherein a signal carrying hollow tube with a fluid therein is mounted on the leading edge, the hollow tube being manipulable to generate a measurable non-electric acoustic signal that is carried by the hollow tube;

an acoustic microphone that detects the measurable non-electric acoustic signal and that outputs a detector output signal representing the non-electric acoustic signal;

a detector processing device that processes the detector output signal to detect a quiescent level of the detector output signal and to detect deviations from the quiescent level indicative of positive or negative changes in pressure in the fluid of the hollow tube, the detector processing device including a low pass filter that filters the detector output signal to remove a background non-electric signal therefrom, the detector processing device outputting a detector processing device output signal; and an output device for causing an audible alarm signal or a visible alarm signal to be output in response to the detector processing device output signal.

31. An alarm system comprising:

a wall-mounted signal carrying hollow tube having a first end and a second end, at least a part of which is manipulable at a manipulating point to generate a measurable non-electric acoustic signal that can be carried by the signal carrying hollow tube;

an acoustic microphone that detects the measurable non-electric acoustic signal and that outputs a detector output signal representing the non-electric acoustic signal;

a detector processing device that processes the detector output signal to detect a quiescent level of the detector output signal and to detect deviations from the quiescent level indicative of positive or negative changes in pressure in the hollow tube, the detector processing device including a low pass filter that filters the detector output signal to remove a background non-electric signal therefrom, the detector processing device outputting a detector processing device output signal; and an output device for causing an electric signal to be output in response to the detector processing device output signal.

32. The safety system of claim 1, wherein the detector processing device processes the detector output signal to detect deviations from the quiescent level indicative of both positive and negative changes in pressure in the fluid of the hollow tube.

* * * * *